US005144756A

United States Patent [19]

Miscione

[11] Patent Number: 5,144,756

[45] Date of Patent: Sep. 8, 1992

[54] BLOW DRYER APPARATUS WITH HEAT ABSORBING AND LIQUID DISPERSING ACCESSORIES FOR PERSONAL AND INDUSTRIAL USE

[76] Inventor: Robert B. Miscione, 6311 Barcelona Ct., Unit 1017, Tucson, Ariz. 85704

[21] Appl. No.: 824,155

[22] Filed: Jan. 22, 1992

[51] Int. Cl.[5] ..... F26B 19/00

[52] U.S. Cl. ..... 34/60; 34/95; 34/96; 34/97

[58] Field of Search ..... 34/97, 90, 91, 96, 95, 34/60; 15/159 R, 110; D4/122, 36; 128/24 R; 132/108

[56] References Cited

U.S. PATENT DOCUMENTS 3,109,437 11/1963 Broyles ..... 34/96 X
3,265,075 8/1966 Edman et al. ..... 34/97 X

*Primary Examiner*—Henry Bennett
*Attorney, Agent, or Firm*—Victor Flores

[57] ABSTRACT

A blow dryer appliance adapted with roller or non-roller accesories for contacting a surface and facilitating combined dryer and roller/non-roller type tasks on a surface. The roller and non-roller accessories are provided in the form of an attachments for the blow dryer member and are designed to accommodate heated air treatment with the appliance on a variety of selected personal or industrial tasks. As a personal care appliance, the roller element's structural features are in the form of a flexible body that conforms to a person's body parts to allow a sponge, or the like, roller surface to collect water particles after bathing. The drying task is enhanced by dispersement of moisture from the person's body facilitated by the combination of heated air evaporating moisture from the absorbent roller. The roller element is completely detachable, washable and/or disposable. Another embodiment for personal use includes the blow dryer and non-roller assembly having a heat absorbing accessory provided with longitudinally arranged ribs or a sponge-like surface designed to provide a warm air massage on a person's body. Industrial applications, such as painting, include use of the apparatus on freshly painted surfaces as a method of accelerating paint drying times.

15 Claims, 2 Drawing Sheets

BLOW DRYER APPARATUS WITH HEAT ABSORBING AND LIQUID DISPERSING ACCESSORIES FOR PERSONAL AND INDUSTRIAL USE

FIELD OF THE INVENTION

The present invention relates to blow drying appliances. More particularly, the present invention relates to blow drying appliances with adaptor accessories for a particular end use. Even more particularly, the present invention relates to blow drying apparatus adapted with heat absorbing and liquid absorbing accessories in the form of roller and non-roller type elements for personal or industrial use.

DESCRIPTION OF THE PRIOR ART

The prior art relating to the present invention concerns: (1) personal and industrial blow dryer appliances having detachable accessories that primarily serve to focus the flow of air at an object, and (2) singular roller elements that are attachable to a pole and commonly used in the painting industry. Blow dryer accessories are known to attach to the blow dryer's nozzle-end. The mechanical interface used by paint rollers include a forked mechanical means attachable to the pole at one end and bearing means at opposing end at the other end for facilitating rolling of the roller element. It is also known to use the blow dryer appliance for personal uses such as drying of the hair and body parts by directing the air nozzle at the hair and body parts and either brush, comb or merely impart a rubbing action using the hands to accelerate the drying process. Other personal use item include hand-held massage units having radiant heat generating means to accomplish a massage or physiotherapy task. Industrial applications for the blow dryer include the high wattage appliances whose nozzle is directed at a workpiece, such as at shrink tubing used in electric cable harnesses. Also, roller elements are known to exist in other forms, in particular, roller elements in the painting industries include a highly porous surface texture material supported on a rigid core body.

While accessories of many type have been adapted for use with the blow dryer, there are no known appliances that combine the attributes of the blow dryer with those of heat absorbing/liquid dispersing type elements to enhance a task involving these elements.

Therefore, need is seen to exist for an apparatus that combines the attributes of a blow dryer with those of heat absorbing/liquid dispersing type devices.

A particular need is seen to exist for a blow dryer apparatus that includes roller accessories for performing a task that involves forcing conditioned air onto the roller accessory to enhance the task performable by the roller accessory.

A particular need is also seen to exist for a blow dryer apparatus that includes a roller element accessory for drying a person's body by blowing heated air onto the roller element and dispersing moisture collected on the roller surface.

Another particular need is seen to exist for a blow dryer apparatus that includes either a roller accessory or non-roller accessory for massaging a person's body.

Still another particular need is seen to exist for an industrial blow dryer apparatus that includes a roller element accessory for applying uniform heat to a surface.

A further need is also seen to exist for an industrial blow dryer apparatus that includes a roller element accessory for applying a liquid substance such as paint onto a surface and accelerating drying of the painted surface.

SUMMARY OF THE INVENTION

Accordingly, the primary object of the present invention is to provide an apparatus that combines the attributes of the blow dryer with those of heat absorbing-/liquid dispersing type elements.

Related objects of the present invention are to provide a blow dryer apparatus that includes: roller or non-roller accessories for performing related tasks enhanced by the blow drying action, including drying a person's body by blowing heated air onto the roller element of the roller accessory and dispersing moisture collected from the body onto the roller surface, massaging a person's body utilizing a flexible rib structure on a roller or non-roller type element, applying uniform heat to a surface utilizing a smooth heat conductive roller element surface, and applying a liquid substance, such as paint, onto a surface and accelerating drying by blowing heated air onto the roller element.

The foregoing objects are accomplished by providing a a blow dryer member and a detachable accessory member, said detachable accessory member comprising a mechanical interface portion and at least one accessory element, said mechanical interface portion having a first attachment means for facilitating detachable securement to said blow dryer member, said at least one accessory element comprising a roller or non-roller heat absorbing element portion having a perforated body member for uniformly distributing hot air emanating from said blow dryer member and enhancing performance of a predetermined task involving a combined use of said blow dryer and said roller or non-roller heat absorbing element portion.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT

Figures 1, 1A, 2:
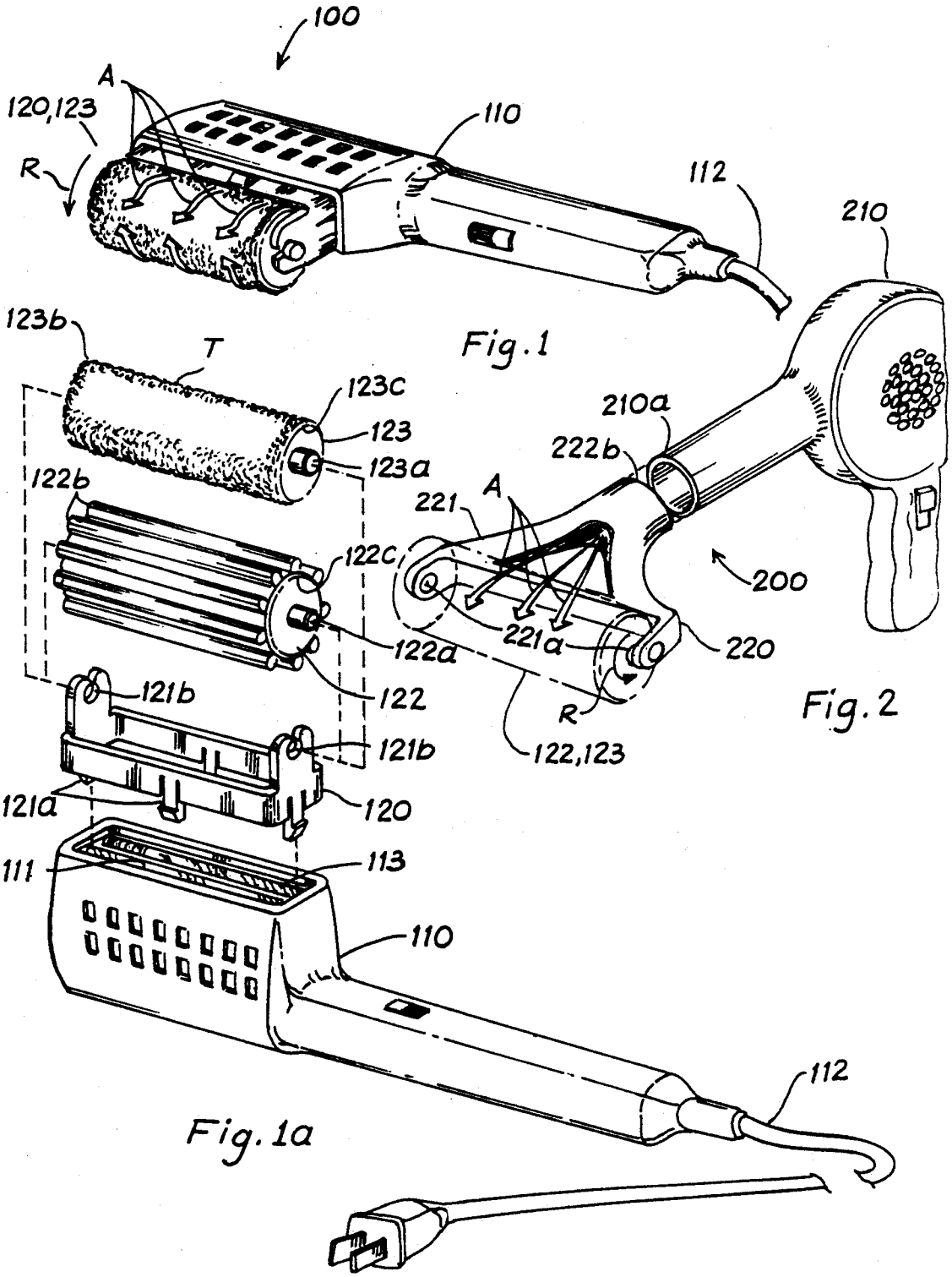
FIG. 1 is a perspective view of a blow dryer appliance according to the present invention, illustrating a roller accessory attached to the outlet port of a blow dryer.
FIG. 1*a* is an exploded view of the present invention, illustrating a snap-on mechanical interface for detachable securement to the blow dryer of either a ribbed structured massage roller or a highly porous roller element.
FIG. 2 is a perspective view of the present invention, illustrating a cylindrical-type mechanical interface for detachable securement to the blow dryer's cylindrical outlet port and also showing a generalized roller accessory of the type shown in FIG. 1*a*.
Figure 4:
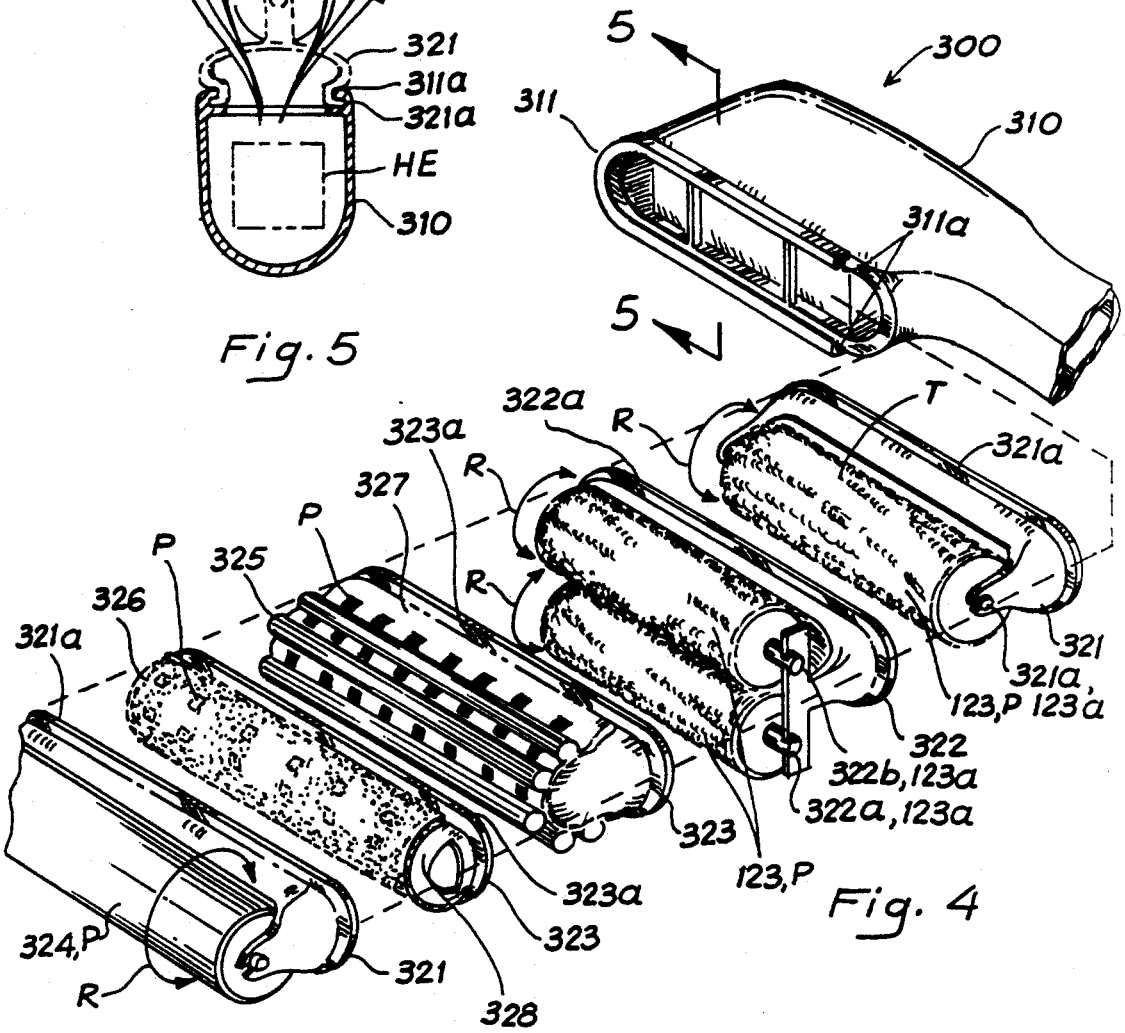
FIG. 4 is an exploded view of the present invention, illustrating a sideward attachment mechanical interface for detachable securement to the blow dryer any one of various types of heat absorbing/liquid dispersing accessories, including a highly absorbent singular roller, a dual highly absorbent set of rollers, a non-roller ribbed massage accessory, a non-roller curved sponge-like surface massage accessory and a smooth, highly heat conductive roller accessory.

FIGS. 1, 2 and 4 show blow dryer appliance apparatus 100, 200 and 300 according to the present invention. Apparatus 100 utilizes a snap-on mechanical interface means, apparatus 200 utilizes a cylindrical mechanical interface means and apparatus 300 utilizes a sideward mechanical interface means for securing the workpieces/accessories to the outlet port of the blow dryer member. Apparatus 100 is seen to comprise a blow dryer member 110, a snap-on mechanical interface 120 and, by example only, roller accessory 123. It should be appreciated that blow dryer member may be energized from an electrical wall outlet using electrical cord 112 or may be otherwise energized by batteries (not shown). Blow dryer 110 is designed to emanate heated air A, while accessory 123 is designed to rotate about bearing portions 121*b* on the mechanical interface 120 to effect rolling action R. FIG. 1*a* shows snap-on mechanical interface 120 having flexible tabs 121*a* for detachable securement to the mating peripheral flange 111 of the air outlet port 113 of blow dryer 110. FIG. 1*a* also shows two roller accessories 122 and 123, both selectively detachable to bearing portions 121*b*. Accessory 122 comprises a ribbed heat absorbing element portion 122*b* disposed on a longitudinally flexible body 122*c* having respective shaft portions 122*a* protruding at opposing ends, each of said shaft portions 122*a* being rotationally secured by said bearing portions 121*b* to facilitate roller action R. Heat absorbing accessory 122, in combination with heated air from blow dryer member 110, is preferably used for roller manipulation of human tissue for massage or physiotherapy purposes. Similarly, accessory 123 comprises a heat absorbing element portion 123*b* having a highly heat absorbing texture T disposed on a longitudinally flexible body 123*c* having respective shaft portions 123*a* protruding at opposing ends, each of said shaft portions 123*a* being rotationally secured by said bearing portions 121*b* to facilitate roller action R. Highly absorbent heat absorbing accessory 123, in combination with heated air from blow dryer member 110, is preferably used for roller tasks including, tasks such as drying a human body by the combined absorbing and heated air treatment of collected water droplets from the human body and dispersement by evaporation caused by the heated air, or painting a surface with a roller and accelerating the drying task by the combined absorbing and heated air treatment of collected paint from the surface and associated dispersement/evaporation caused by the heated air.

FIG. 2 shows embodiment 200 with mechanical interface 220 having a first attachment means formed as a cylindrical end member 222*b* and a second attachment means 221 comprising a plurality of laterally spaced, bearing portions 221*a* for facilitating rotational securement to at least one roller accessory element, shown generally as accessories 122 and 123, (see FIG. 4 for a dual roller accessory attached to the bearing portions). Blow dryer member 210 comprises a cylindrical air outlet port 210*a* whereby said at least one roller accessory element can be detachably secured to said blow dryer member 210 by engagement of said cylindrical end member 222*b* with said cylindrical air outlet port 210*a*.

Figure 3:
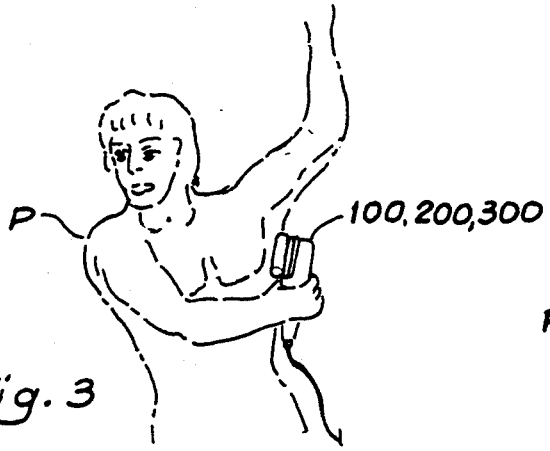
FIG. 3 is a personal use application view, illustrating a person utilizing the present invention for drying moisture from the body.
Figure 6:
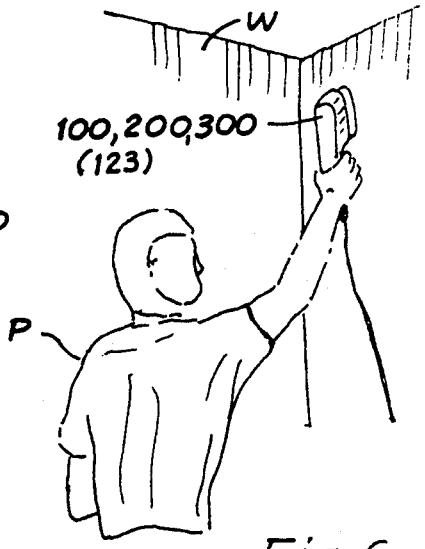
FIG. 6 is an industrial application view of the present invention, illustrating a person applying a liquid substance to a wall for purposes of accelerating the drying process.

FIG. 4 shows blow dryer apparatus embodiment 300, according to the present invention, where a sideward type of mechanical interface is utilized to detachably secure any one of several roller/non-roller heat absorbing/liquid dispersing accessories to blow dryer member 310. The roller accessories are seen to comprise mechanical portions 321, 322 and roller elements 123 and 324, where mechanical interface portion 321 is used with a single roller type element having protruding shaft portions 123*a* for rotational securement to bearing interface portions at 321*a*. The single roller type elements include a highly absorbent roller element 123, or a smooth, highly conductive roller element 324, and where mechanical interface portion 322 is used with a dual set of roller elements 123 having protruding shaft portions 123*a* for rotational securement to bearing interface portions 322*a* and 322*b*. The non-roller accessories are seen to comprise, by example, a mechanical interface portion 323 for use with heat absorbing massage accessories 325 and 326. In either mechanical interface portions 321, 322 or 323, a first attachment means, comprising an outwardly extending flange member 321*a*, 322*a* and 323*a*, is used to mate with a grooved flange member 311*a* disposed around a peripheral portion of air outlet port 311. Highly absorbent roller 123 is textured with a material suitable for contacting a person's body in a personal type of application, as shown in use by a person P in FIG. 3, and may be formed in different sizes and having different textures T. In the industrial applications of roller 123, such as where a painting task is involved, the surface material on the roller element may be the same as that presently used in the painting industry. FIG. 6 shows a person P applying paint to a wall W using any one of embodiments 100, 200 or 300 for accelerating the paint drying process. One difference in the roller design for personal versus industrial application being that, in the case of a personal application, the body member, beneath the absorbent material is formed as a perforated, longitudinally flexible body to conform to curved body parts, and in the case of an industrial applications the body member beneath the absorbent material is a longitudinally rigid body member to maintain contact with a flat surface. In both cases, the perforations P beneath the absorbent material serve to facilitate uniform air flow through the roller element to accelerate dispersement of a liquid absorbed by the roller element. In the case of highly heat conductive roller element 324 the surface material is intended to uniformly transfer heat onto a surface, such as a task where a linoleum floor is being heated to soften the underlying adhesive used to originally install the linoleum. Here, the longitudal body member is provided with perforations P to assure uniform heated air distribution onto the heat conductive surface. In a similar fashion, the massage accessories 325 and 326 are provided with a longitudinal body member 327, 328 respectively, having perforations P to uniformly distribute the heated air onto the massage structure.

Figure 5:
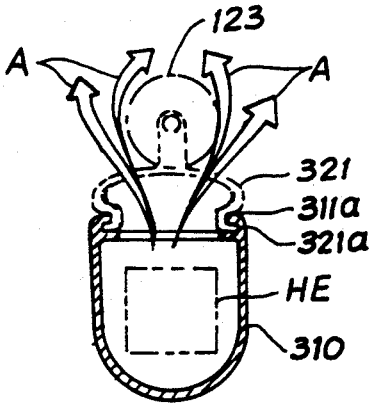
FIG. 5 is a cross-sectional view taken along line 5—5 of FIG. 4 illustrating an arbitrary roller accessory attached to the sideward mount mechanical interface and showing also the flow of heated air emanating from a heating element found within the blow dryer member.

FIG. 5 shows a cross-section view of roller accessory 123 attached to blow dryer member 310. In particular is shown flange 321*a* engaged with groove 311*a* to effect the sideward mount mechanical interface. Also shown, is the flow of heated air A surrounding the roller element 123, as well as showing heating element HE found within the blow dryer member 310.

Therefore, while the present invention has been shown and described herein in what is believed to be the most practical and preferred embodiment, it is recognized that departures can be made therefrom within the scope of the invention, which scope is therefore not to be limited to the details disclosed herein but is to be accorded the full scope of the claims so as to embrace any and all equivalent apparatus.

I claim:

1. A blow dryer appliance apparatus, said apparatus comprising:

a blow dryer member; and a detachable accessory member, said detachable accessory member comprising a mechanical interface portion and at least one accessory element, said mechanical interface portion having a first attachment means for facilitating detachable securement to said blow dryer member, said at least one accessory element comprising a heat absorbing element portion having a perforated body member for uniformly distributing hot air emanating from said blow dryer member and enhancing performance of a predetermined task involving a combined use of said blow dryer and said heat absorbing element portion, said at least one accessory element comprises at least one roller accessory element;

said mechanical interface portion further comprises a second attachment means for faciliating rotational securement to said at least one roller accessory element, said second attachment means comprising a plurality of laterally spaced, bearing portions; and said at least one roller element comprises said heat absorbing element portion and said perforated body member, said perforated body member being formed as a longitudinally flexible body having respective shaft portions protruding at opposing ends, each of said shaft portions being rotationally secured by said bearing portions to facilitate roller action.

2. A blow dryer appliance apparatus, as recited in claim 1, wherein:

said first attachment means comprising an outwardly extending flange member;

said blow dryer member comprising an air outlet port, said air outlet port having a grooved flange member disposed around a peripheral portion of said air outlet port, said detachable accessory member being detachably secured to said blow dryer member by engagement of said outwardly extending flange member with said grooved flange member.

3. A blow dryer appliance apparatus, as recited in claim 1, wherein:

said first attachment means comprises a cylindrical end member; and said blow dryer member comprises a cylindrical air outlet port, said detachable accessory member being detachably secured to said blow dryer member by engagement of said cylindrical end member with said cylindrical air outlet port.

4. A blow dryer appliance apparatus, said apparatus comprising:

a blow dryer member; and a detachable accessory member, said detachable accessory member comprising a mechanical interface portion and at least one accessory element, said mechanical interface portion having a first attachment means for facilitating detachable securement to said blow dryer member, said at least one accessory element comprising a heat absorbing element portion having a perforated body member for uniformly distributing hot air emanating from said blow dryer member and enhancing performance of a predetermined task involving a combined use of said blow dryer and said heat absorbing element portion, said at least one accessory element comprises at least one roller accessory element;

said mechanical interface portion comprises a second attachment means for facilitating rotational securement to said at least one roller accessory element, said second attachment means comprising a plurality of laterally spaced, bearing portions; and said at least one roller element comprises said heat absorbing element portion and said perforated body member, said perforated body member being formed as a longitudinally flexible body having respective shaft portions protruding at opposing ends, each of said shaft portions being rotationally secured by said bearing portions to facilitate roller action, said heat absorbing element portion being a highly fluid absorbent material disposed on said flexible body, said highly fluid absorbent material co-acting with heated air emanating from said blow dryer member to accelerate dispersement of a liquid from a body, said absorbent material being dried simultaneously with a fluid being dispersed.

5. A blow dryer appliance apparatus, as recited in claim 4, wherein:

said first attachment means comprising an outwardly extending flange member;

said blow dryer member comprising an air outlet port, said air outlet port having a grooved flange member disposed around a peripheral portion of said air outlet port, said detachable accessory member being detachably secured to said blow dryer member by engagement of said outwardly extending flange member with said grooved flange member.

6. A blow dryer appliance apparatus, as recited in claim 4, wherein:

said first attachment means comprises a cylindrical end member; and said blow dryer member comprises a cylindrical air outlet port, said detachable accessory member being detachably secured to said blow dryer member by engagement of said cylindrical end member with said cylindrical air outlet port.

7. A blow dryer appliance apparatus, said apparatus comprising:

a blow dryer member; and a detachable accessory member, said detachable accessory member comprising a mechanical interface portion and at least one accessory element, said mechanical interface portion having a first attachment means for facilitating detachable securement to said blow dryer member, said at least one accessory element comprising a heat absorbing element portion having a perforated body member for uniformly distributing hot air emanating from said blow dryer member and enhancing performance of a predetermined task involving a combined use of said blow dryer and said heat absorbing element portion, said heat absorbing element portion comprises a ribbed heat absorbing structure for manipulating human tissue for massage or physiotherapy purposes.

8. A blow dryer appliance apparatus, as recited in claim 7, wherein:

said at least one accessory element comprises at least one roller accessory element provided with said ribbed heat absorbing structure, said perforated body member having respective shaft portions protruding at opposing ends;

said mechanical interface portion further comprises a second attachment means comprising a plurality of laterally spaced, bearing portions for facilitating rotational securement to said shaft portions;

said first attachment means comprising an outwardly extending flange member;

said blow dryer member comprising an air outlet port, said air outlet port having a grooved flange member disposed around a peripheral portion of said air outlet port, said detachable accessory member being detachably secured to said blow dryer member by engagement of said outwardly extending flange member with said grooved flange member.

9. A blow dryer appliance apparatus, as recited in claim 7, wherein:

said first attachment means comprises a cylindrical end member; and said blow dryer member comprises a cylindrical air outlet port, said detachable accessory member being detachably secured to said blow dryer member by engagement of said cylindrical end member with said cylindrical air outlet port.

10. A blow dryer appliance apparatus, said apparatus comprising:

a blow dryer member; and a detachable accessory member, said detachable accessory member comprising a mechanical interface portion and at least one accessory element, said mechanical interface portion having a first attachment means for facilitating detachable securement to said blow dryer member, said at least one accessory element comprising a heat absorbing element portion having a perforated body member for uniformly distributing hot air emanating from said blow dryer member and enhancing performance of a predetermined task involving a combined use of said blow dryer and said heat absorbing element portion, said at least one accessory element comprises at least one roller accessory element;

said mechanical interface portion further comprises a second attachment means for facilitating rotational securement to said at least one roller accessory element, said second attachment means comprising a plurality of laterally spaced, bearing portions; and said at least one roller element comprises said heat absorbing element portion and said perforated body member, said heat absorbing element portion being a smooth, highly heat conductive surface to facilitate uniform heat transfer of heated air from said blow dryer to a flat surface, said perforated body member being formed as a longitudinally rigid body having respective shaft portions protruding at opposing ends, each of said shaft portions being rotationally secured by said bearing portions to facilitate roller action.

11. A blow dryer appliance apparatus, as recited in claim 10, wherein:

said first attachment means comprising an outwardly extending flange member;

said blow dryer member comprising an air outlet port, said air outlet port having a grooved flange member disposed around a peripheral portion of said air outlet port, said detachable accessory member being detachably secured to said blow dryer member by engagement of said outwardly extending flange member with said grooved flange member.

12. A blow dryer appliance apparatus, as recited in claim 10, wherein:

said first attachment means comprises a cylindrical end member; and said blow dryer member comprises a cylindrical air outlet port, said detachable accessory member being detachably secured to said blow dryer member by engagement of said cylindrical end member with said cylindrical air outlet port.

13. A method of uniformly distributing hot air emanating from a blow dryer member and enhancing performance of a predetermined task involving a combined use of said blow dryer member and a detachable accessory, said method comprising the steps of:

(a) selecting a task performable by a blow dryer appliance including said blow dryer member and said detachable accessory, said task selected from a group of tasks comprising dispersement of a liquid from a surface, and manipulating human tissue for massage or physiotherapy purposes;

(b) providing said blow dryer appliance apparatus for performing said selected task, said apparatus comprising:

a blow dryer member, and a detachable accessory member, said detachable accessory member comprising a mechanical interface portion and at least one accessory element, said mechanical interface portion having a first attachment means for facilitating detachable securement to said blow dryer member, said at least one accessory element comprising a heat absorbing element portion having a perforated body member for uniformly distributing hot air emanating from said blow dryer member;

(c) attaching said detachable accessory member to said blow dryer member;

(d) energizing said blow dryer member to cause heated air to blow onto said heat absorbing element; and (e) performing said selected task using said blow dryer appliance apparatus, said heat absorbing element acting on a body such that said heated air enhances performance of said selected task, said step (a) of selecting a task includes selecting a liquid dispersement task consisting of drying moisture from a person's body;

said step (b) of providing a blow dryer appliance apparatus comprises:

providing said mechanical interface portion having a second attachment means, said second attachment means comprising a plurality of laterally spaced, bearing portions, providing said at least one accessory element as at least one roller element, wherein, said heat absorbing element portion comprises a highly absorbent material disposed on said perforated body member, said perforated body member being a longitudinally flexible body having respective shaft portions protruding at opposing ends, each of said shaft portions being rotationally secured to said second attachment means to facilitate roller action of said at least one roller element, providing said first attachment means having an outwardly extending flange member, providing said blow dryer member having an air outlet port, said air outlet port having a grooved flange member disposed around a peripheral portion of said air outlet port;

said step (c) of attaching said detachable accessory member to said blow dryer member includes engaging said outwardly extending flange member with said grooved flange member; and said step (e) comprises performing repeated rolling action using said at least one roller element on said person's body such that said highly absorbent surface material, co-acting with heated air emanating from said blow dryer member, accelerates dispersement of moisture from said person's body by simultaneously absorbing and dispersing said moisture until achieving a desired consistency of dryness.

14. A method of uniformly distributing hot air emanating from a blow dryer member and enhancing performance of a predetermined task involving a combined use of said blow dryer member and a detachable accessory, said method comprising the steps of:

(a) selecting a task performable by a blow dryer appliance including said blow dryer member and said detachable accessory, said task selected from a group of tasks comprising dispersement of a liquid from a surface, and manipulating human tissue for massage or physiotherapy purposes;

(b) providing said blow dryer appliance apparatus for performing said selected task, said apparatus comprising:

a blow dryer member, and a detachable accessory member, said detachable accessory member comprising a mechanical interface portion and at least one accessory element, said mechanical interface portion having a first attachment means for facilitating detachable securement to said blow dryer member, said at least one accessory element comprising a heat absorbing element portion having a perforated body member for uniformly distributing hot air emanating from said blow dryer member;

(c) attaching said detachable accessory member to said blow dryer member;

(d) energizing said blow dryer member to cause heated air to blow onto said heat absorbing element; and (e) performing said selected task using said blow dryer appliance apparatus, said heat absorbing element acting on a body such that said heated air enhances performance of said selected task, said step (a) of selecting a task includes selecting a task of applying paint to a wall and quickly drying said applied paint from said wall;

said step (b) of providing a blow dryer appliance apparatus comprises:

providing said mechanical interface portion having a second attachment means, said second attachment means comprising a plurality of laterally spaced, bearing portions, providing said at least one accessory element as at least one roller element, wherein, said heat absorbing element portion comprises a paint absorbent material disposed on said perforated body member, said perforated body member being a longitudinally flexible body having respective shaft portions protruding at opposing ends, each of said shaft portions being rotationally secured to said second attachment means to facilitate roller action of said at least one roller element, providing said first attachment means as a cylindrical end member; and providing said blow dryer member having a cylindrical air outlet port;

said step (c) of attaching said detachable accessory member to said blow dryer member includes engaging said cylindrical end member with said cylindrical air outlet port;

said steps (d) and (e) are performed by providing a paint substance in a suitable container for use with said apparatus, dabbing said at least one roller element with said provided paint substance, applying said paint substance to a wall using said roller element, then energizing said blow dryer member to cause heated air to blow onto said roller element, and performing repeated rolling action on said applied paint substance until achieving a desired consistency of dryness of said paint substance.

15. A method of uniformly distributing hot air emanating from a blow dryer member and enhancing performance of a predetermined task involving a combined use of said blow dryer member and a detachable accessory, said method comprising the steps of:

(a) selecting a task performable by a blow dryer appliance including said blow dryer member and said detachable accessory, said task selected from a group of tasks comprising dispersement of a liquid from a surface, and manipulating human tissue for massage or physiotherapy purposes;

(b) providing said blow dryer appliance apparatus for performing said selected task, said apparatus comprising:

a blow dryer member, and a detachable accessory member, said detachable accessory member comprising a mechanical interface portion and at least one accessory element, said mechanical interface portion having a first attachment means for facilitating detachable securement to said blow dryer member, said at least one accessory element comprising a heat absorbing element portion having a perforated body member for uniformly distributing hot air emanating from said blow dryer member;

(c) attaching said detachable accessory member to said blow dryer member;

(d) energizing said blow dryer member to cause heated air to blow onto said heat absorbing element; and (e) performing said selected task using said blow dryer appliance apparatus, said heat absorbing element acting on a body such that said heated air enhances performance of said selected task, said step (a) of selecting a task includes selecting a task consisting of manipulating tissue on a person's body for massage or physiotherapy purposes;

said step (b) of providing a blow dryer appliance apparatus comprises:

providing said heat absorbing element portion as a ribbed heat absorbing structure for performing said task of manipulating tissue on a person's body, providing said first attachment means having an outwardly extending flange member, providing said blow dryer member having an air outlet port, said air outlet port having a grooved flange member disposed around a peripheral portion of said air outlet port;

said step (c) of attaching said detachable accessory member to said blow dryer member includes engaging said outwardly extending flange member with said grooved flange member; and said step (e) comprises massaging a person's body using said ribbed heat absorbing structure coacting with heated air emanating from said blow dryer member.

* * * * *